US007553198B1

(12) United States Patent
Leddy

(10) Patent No.: US 7,553,198 B1
(45) Date of Patent: Jun. 30, 2009

(54) RE-CONFIGURABLE ELECTRICAL CONNECTORS

(75) Inventor: Thomas Leddy, Eastport, NY (US)

(73) Assignee: Advanced Testing Technologies, Inc., Hauppauge, NY (US)

( * ) Notice: Subject to any disclaimer, the term of this patent is extended or adjusted under 35 U.S.C. 154(b) by 96 days.

(21) Appl. No.: 11/870,545

(22) Filed: Oct. 11, 2007

Related U.S. Application Data

(63) Continuation-in-part of application No. 11/453,660, filed on Jun. 15, 2006, now Pat. No. 7,297,031.

(60) Provisional application No. 60/741,284, filed on Dec. 1, 2005.

(51) Int. Cl.
*H01R 13/502* (2006.01)

(52) U.S. Cl. ..... 439/701

(58) Field of Classification Search ..... 439/701, 439/532

See application file for complete search history.

(56) References Cited

U.S. PATENT DOCUMENTS

| | | | |
|---|---|---|---|
| 4,484,792 | A | 11/1984 | Tengler et al. |
| 4,519,667 | A | 5/1985 | Canning et al. |
| 4,662,705 | A | 5/1987 | Prechtl et al. |
| 5,386,518 | A | 1/1995 | Reagle et al. |
| 5,668,419 | A | 9/1997 | Oktay |
| 5,681,175 | A | 10/1997 | Busse et al. |
| 5,795,174 | A | 8/1998 | Saito et al. |
| 5,915,982 | A | 6/1999 | Kashiyama et al. |
| 5,964,602 | A | 10/1999 | Aoki et al. |
| 6,069,992 | A | 5/2000 | Hyzin |
| 6,102,746 | A | 8/2000 | Nania et al. |
| 6,155,850 | A | 12/2000 | Martin et al. |
| 6,168,445 | B1 | 1/2001 | Seutschniker et al. |
| 6,217,354 | B1 | 4/2001 | Fenci et al. |
| 6,241,539 | B1 | 6/2001 | Sato et al. |
| 6,305,957 | B1 | 10/2001 | Fink et al. |
| 6,345,995 | B1 | 2/2002 | Bigotto et al. |
| 6,354,852 | B2 | 3/2002 | Noro et al. |
| 6,413,105 | B2 | 7/2002 | Noro et al. |
| 6,461,177 | B1 | 10/2002 | Saka et al. |
| 6,464,546 | B2 | 10/2002 | LaCoy |
| 6,824,406 | B1 | 11/2004 | Sharples et al. |
| 6,848,922 | B2 | 2/2005 | Coughlan et al. |
| 6,916,990 | B2 | 7/2005 | Behziz et al. |
| 2004/0157499 | A1 | 8/2004 | Nania et al. |

OTHER PUBLICATIONS

Aldo Bruni, "Latching Mechanism for Plug and Socket Type Electrical Connector", abstract of EP0363804, Apr. 18, 1998.

*Primary Examiner*—Neil Abrams
*Assistant Examiner*—Phuong Nguyen
(74) *Attorney, Agent, or Firm*—Brian Roffe

(57) ABSTRACT

Re-configurable electrical connector including a pair of endcaps, a pair of elongate rails, each removably attached at one end to one of the endcaps, and connector modules arranged between the endcaps and including one or more male or female connecting members adapted to electrically connect at a first end to one electrical component or part thereof and at a second, opposite end to another electrical component or part thereof. The connector modules are individual modules in the sense that they are separated from one another. When the rails are detached from the endcaps, each connector module can be moved relative to the rails, i.e., slid off of the end of the rails, to enable different configurations of connector modules to be positioned between the endcaps.

25 Claims, 10 Drawing Sheets

FIG. 17
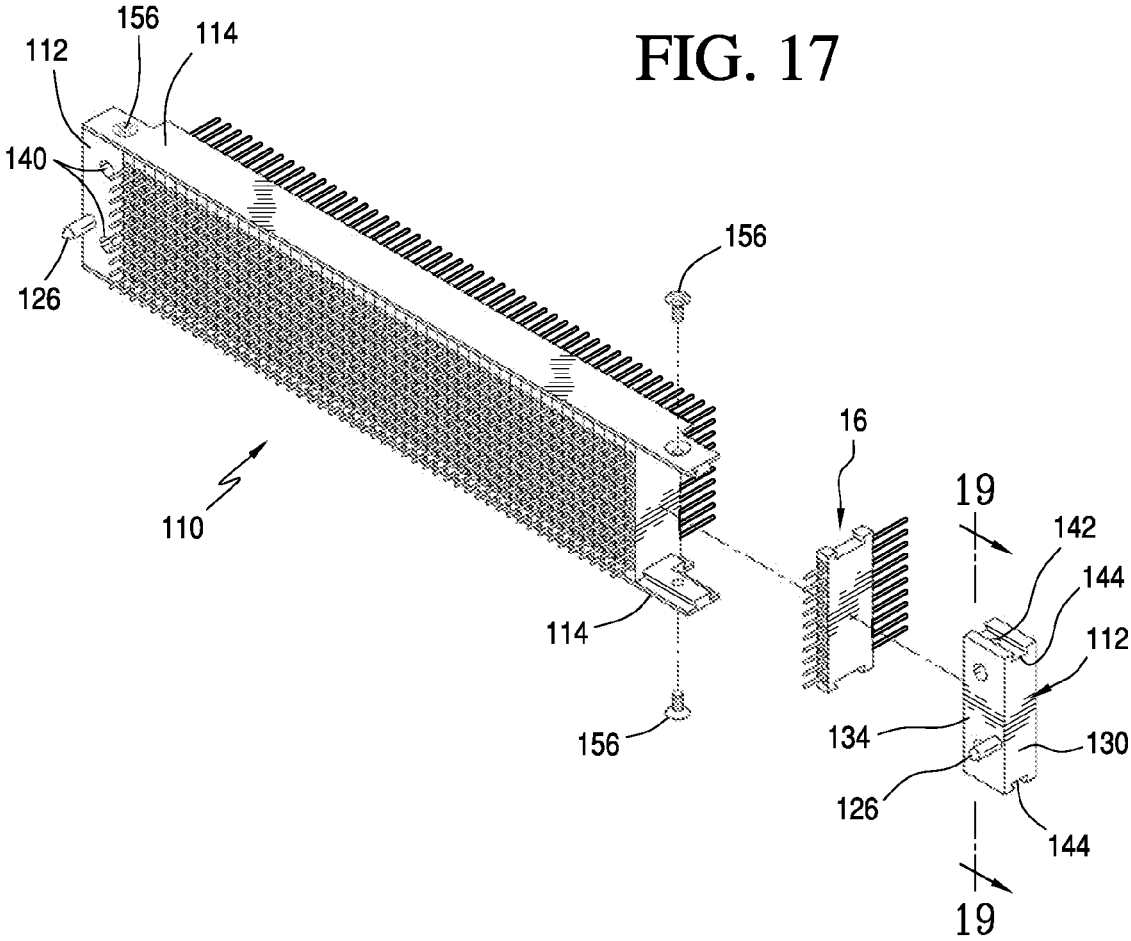
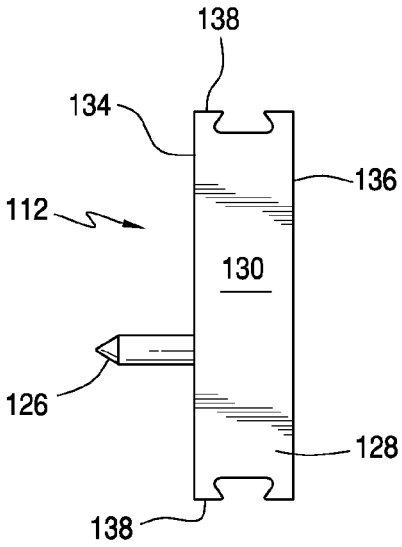
FIG. 18
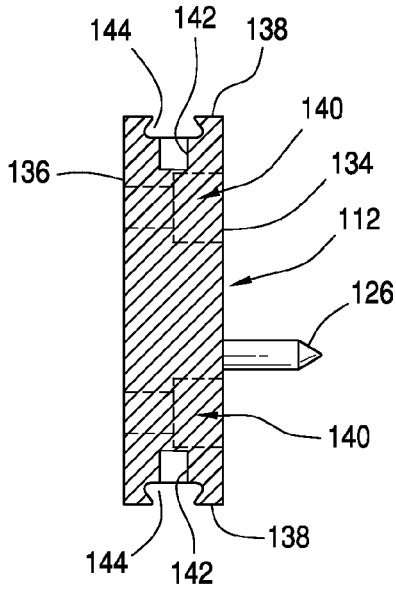
FIG. 19

RE-CONFIGURABLE ELECTRICAL CONNECTORS

CROSS REFERENCE TO RELATED APPLICATIONS

This application is a continuation-in-part of U.S. patent application Ser. No. 11/453,660 filed Jun. 15, 2006 which claims priority under 35 U.S.C. §119(e) of U.S. provisional patent application Ser. No. 60/741,284 filed Dec. 1, 2005, the entire contents of which are incorporated by reference herein.

FIELD OF INVENTION

The present invention relates generally to electrical connectors which connect electrical components together and more particularly to electrical connectors which can be adjusted to provide for different configurations of connecting members so that the connectors can be used with different electrical components.

BACKGROUND OF INVENTION

Electrical connectors are needed to connect electrical components together. As used herein, electrical components include cables, wires, patch panels and the like. Each connector is typically provided with a fixed configuration of male or female connecting members which enables it to connect only to an electrical component with the complementary configuration of connecting members. There is therefore no flexibility to use the same connector to connect to two or more electrical components having different configurations of connecting members.

It would be beneficial if a single connector were able to be re-configurable to connect to electrical components having different configurations of connecting members.

OBJECTS AND SUMMARY OF INVENTION

It is an object of the present invention to provide new and improved electrical connectors which connect electrical components together.

It is another object of the present invention to provide new and improved electrical connectors which are adjustable to provide different configurations of connecting members so that the same connectors can be used with electrical components having different configurations of connecting members.

It is yet another object of the present invention to provide new and improved electrical connectors which are re-configurable to connect to electrical components having different configurations of connecting members.

In order to achieve these objects and others, one embodiment of an electrical connector for removable attachment to a plurality of different electrical connectors in accordance with the invention includes a pair of endcaps, a pair of elongate rails, each removably attached at one end to one of the endcaps (and possibly removably attached at each end to a respective endcap), and connector modules arranged between the endcaps and including one or more male or female connecting members adapted to electrically connect at a first end to one electrical component or connecting member thereof and at a second, opposite end to another electrical component or connecting member thereof. The connector modules are individual modules in the sense that they are separated or separable from one another and movable relative to one another. When the rails are attached to the endcaps, the connector modules are fixed in position by the attachment of the rails to the endcaps, but when the rails are separated or detached from the endcaps, each connector module can be moved relative to the rails, i.e., slid off of the end of the rails. By arranging different numbers and types of connector modules along the rails between the endcaps, different configurations of connector modules and thus different connectors can be provided.

More specifically, in one configuration of the connector modules, all of the connector modules are identical and include a pre-determined number of male connecting members, e.g., pins, or female connecting members, e.g., sockets. To obtain a different configuration of connector modules, one or more of the connector modules is removed and replaced with a connector module having a different number of connecting members or possibly even with a blank, i.e., a module without any connecting members. Replacement of the connector modules(s) would be performed when the connector is intended to be used to connect to a different electrical component, i.e., an electrical component having a different complementary configuration of connecting members. Thus, when the connector modules are all identical, the connector connects to one electrical component and when the connector modules are not all identical, the connector connected to a second, different electrical component.

By selecting particular connector modules and their relative position between the endcaps and/or orientation relative to the endcaps, numerous different configurations of connectors can be obtained. Moreover, changing between connector configurations is easy to perform as it entails simply separating or detaching the rails from the endcaps, moving one or more of the connector modules out of engagement with the rails, placing connector modules in the new, desired order and in engagement with the rails, and then re-attaching the rails and the endcaps together.

The endcaps may be different depending on whether the connector is used in a fixture or a receiver. In the former case, the fixture includes male endcaps each having one or more coupling members oriented so that a projecting portion thereof is in the same direction as the mating surface whereas in the latter case, the receiver includes female endcaps each having a similar number of coupling members oriented so that a recessed portion thereof is in the same direction as the mating surface. In one embodiment, the male endcap includes a single guide pin and the coupling member and the female endcap includes a single aperture as the coupling member which is constructed to receive the guide pin. In other embodiments, a pair of coupling members is provided on each of the male and female endcaps.

One particularly useful configuration of a female connector in accordance with the invention is one in which the connector is adapted for connection to a Virginia Panel Series 90 patch panel and wherein there are 480 Hypertronics contacts arranged in 48 connector modules each including 10 sockets. Another useful configuration is one in which the female connector is adapted for connection to a Mac Panel 60 RFI patch panel and wherein there are 500 Hypertronics contacts arranged in 50 connector modules each including 10 sockets.

To provide for engagement between the endcaps and the rails, each endcap includes one or more channels on each side and each rail includes a similar number of elongate projections having a form substantially complementary to the form of the channel(s), e.g., a dovetail form. Each projection on the rail is slidable into and along a respective channel on a respective side of the endcaps. That is, on each side of each endcap, there are one or more channels and each channel aligns with a respective one of the channels on the same side of the other endcap. One projection on the rail engages with each aligning pair of channels. In one embodiment, each endcap includes only a single channel on each side and thus each rail includes only a single projection. In another embodiment, each endcap includes two channels on each side and each rail includes two projections.

Screws or another attachment mechanism are used to removably attach the rails to the endcaps. Such screws may be placed at one or both ends of the rails so that the rails can be removably attached to only one endcap or to both endcaps.

A dielectric housing of the connector modules is also provided with a channel on each side having a form complementary to the form of a projection on the rail. Accordingly, in its assembled form, this projection on each rail is situated within the channel on a respective side of the housings of the connector modules to thereby secure the connector modules in place between the endcaps.

Another way to consider the electrical connector in accordance with the invention is as a connector having individual connector modules each including at least one male or female connecting member adapted to electrically connect at a first end to a first electrical component or connecting member thereof and at a second, opposite end to a second electrical component or connecting member thereof, a pair of elongate rails and a pair of endcaps. Each connecting member preferably includes a single projection at the first end for engaging with the first electrical component or connecting member thereof and a single projection or receptacle at the second end for engaging with the second electrical component or connecting member thereof. Each connector module engages at one side with one rail and at an opposite side with the other rail. Each rail is removably attached at one end to one of the endcaps, and possibly at each end to a respective endcap. When the rails are separated or detached from the endcap(s), different configurations of connector modules are positionable between the endcaps, to thereby form different connectors in a similar manner as described above.

Yet another way to consider an electrical connector in accordance with the invention is as a connector including a frame having a plurality of side members defining an interior space, at least a first side member being detachable from any remaining side members (or assembly thereof) to enable access to the interior space. The side members could be the endcaps and rails described above, with one of the endcaps being detachable from the remaining assembly of the rails and other endcap, or may be other forms of rigid members which cooperate to define a border around an interior space. Connector modules are arranged in the interior space defined by the side members. The connector modules are separated from one another and each includes at least one male or female connecting member adapted to electrically connect at a first end to a first electrical component or part thereof and at a second, opposite end to a second electrical component or part thereof. The connector includes cooperating channels and projections formed in the frame and the connector modules to enable relative movement between the connector modules and the frame such that when the first side member is detached from any remaining side members, enable different configurations of connector modules can be arranged in the interior space and thereby provide for removable engagement with a plurality of different first electrical components and a plurality of different second electrical components.

Other objects and advantages of the present claimed invention and inventions disclosed below are set forth below and others will become apparent from the following description of preferred embodiments taken in conjunction with the accompanying drawings.

BRIEF DESCRIPTION OF THE DRAWINGS

The following drawings are illustrative of embodiments of the invention and are not meant to limit the scope of the invention as encompassed by the claims.

FIG. 17 is a perspective view of a third embodiment of a connector in accordance with the invention.

FIG. 18 is a side view of an endcap of the connector shown in FIG. 17.

FIG. 19 is a view taken along the line 19-19 of FIG. 17.

DETAILED DESCRIPTION OF THE INVENTION

Figure 1:
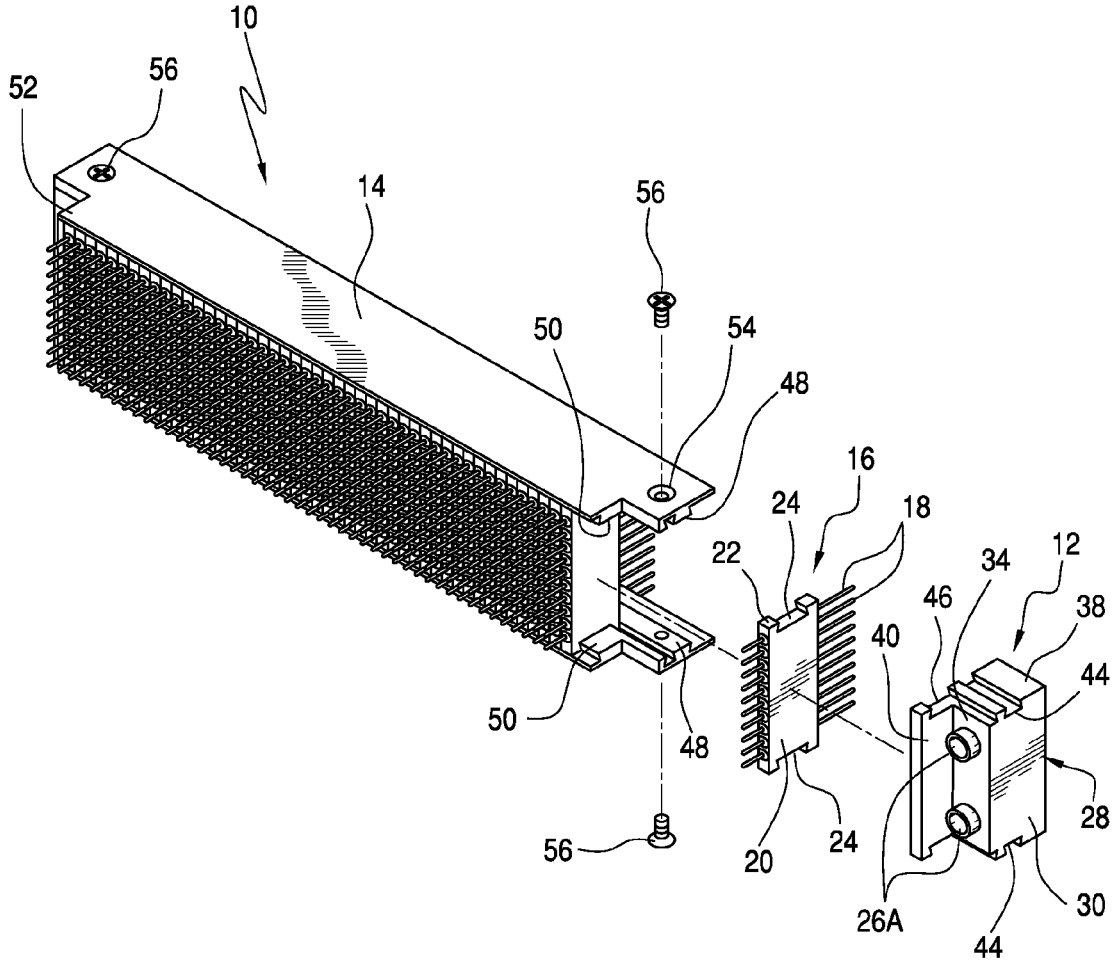
FIG. 1 is a perspective view of a first embodiment of a connector in accordance with the invention.
Figure 2:
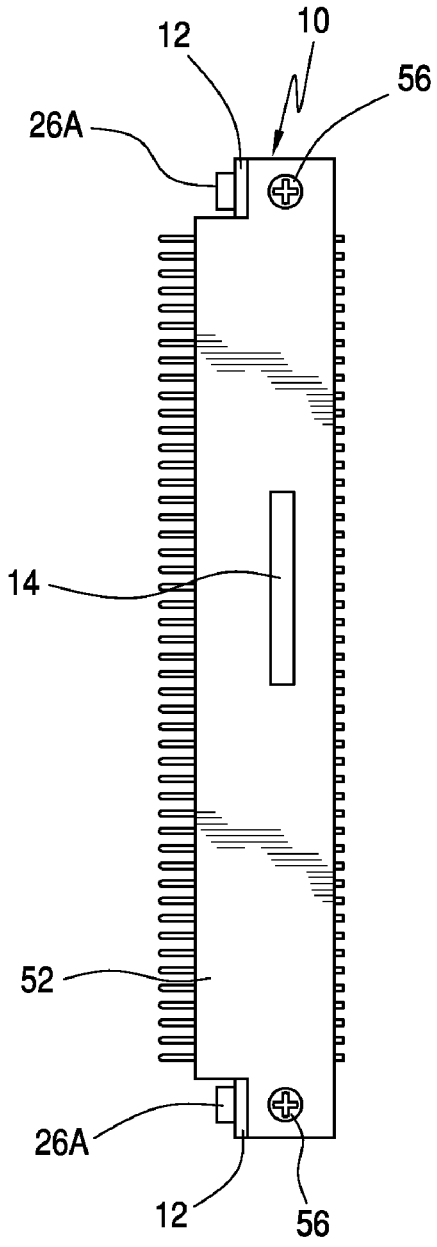
FIG. 2 is a side view of the connector shown in FIG. 1.
Figure 3:
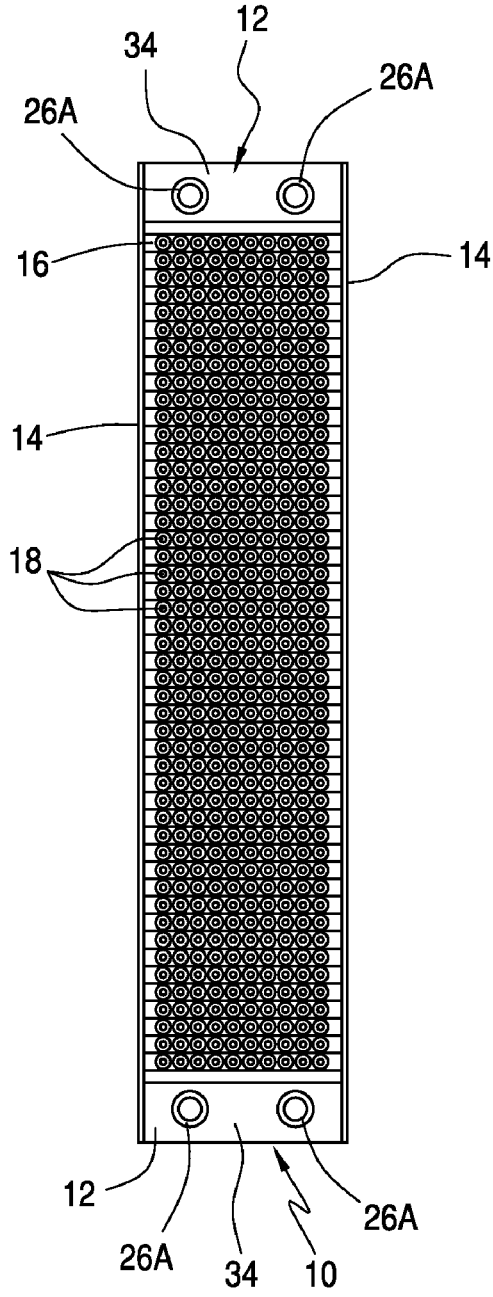
FIG. 3 is a front view of the connector shown in FIG. 1.

Referring to the accompanying drawings wherein like reference numerals refer to the same or similar elements, a first embodiment of an electrical connector in accordance with the invention is shown in FIGS. 1-10 and is designated generally as 10. Connector 10 includes a pair of endcaps 12, a pair of elongate rails 14 attached at their ends to the endcaps 12 and a plurality of connector modules 16 arranged between the endcaps 12 and in engagement with the rails 14.

Figure 9:
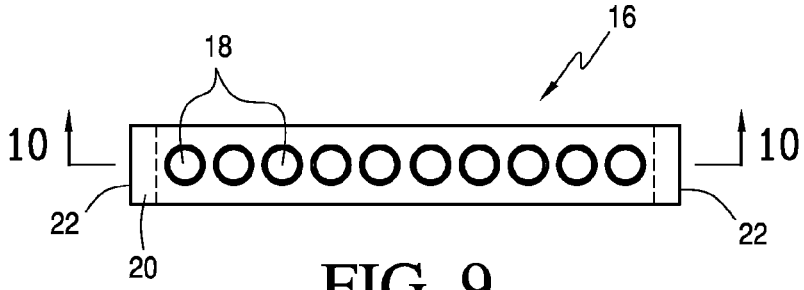
FIG. 9 is a front view of the connector module shown in FIG. 8.
Figure 10:
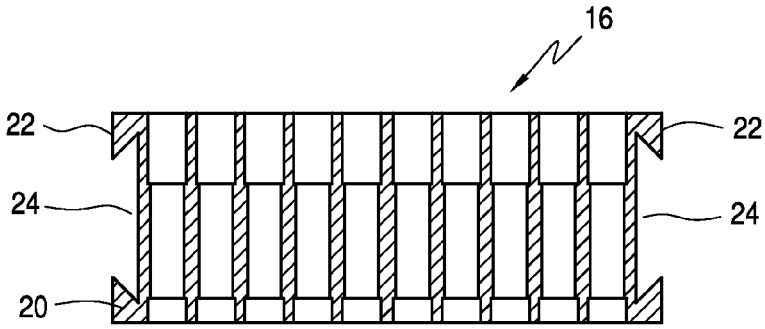
FIG. 10 is a view taken along the line 10-10 of FIG. 9.
Figure 11:
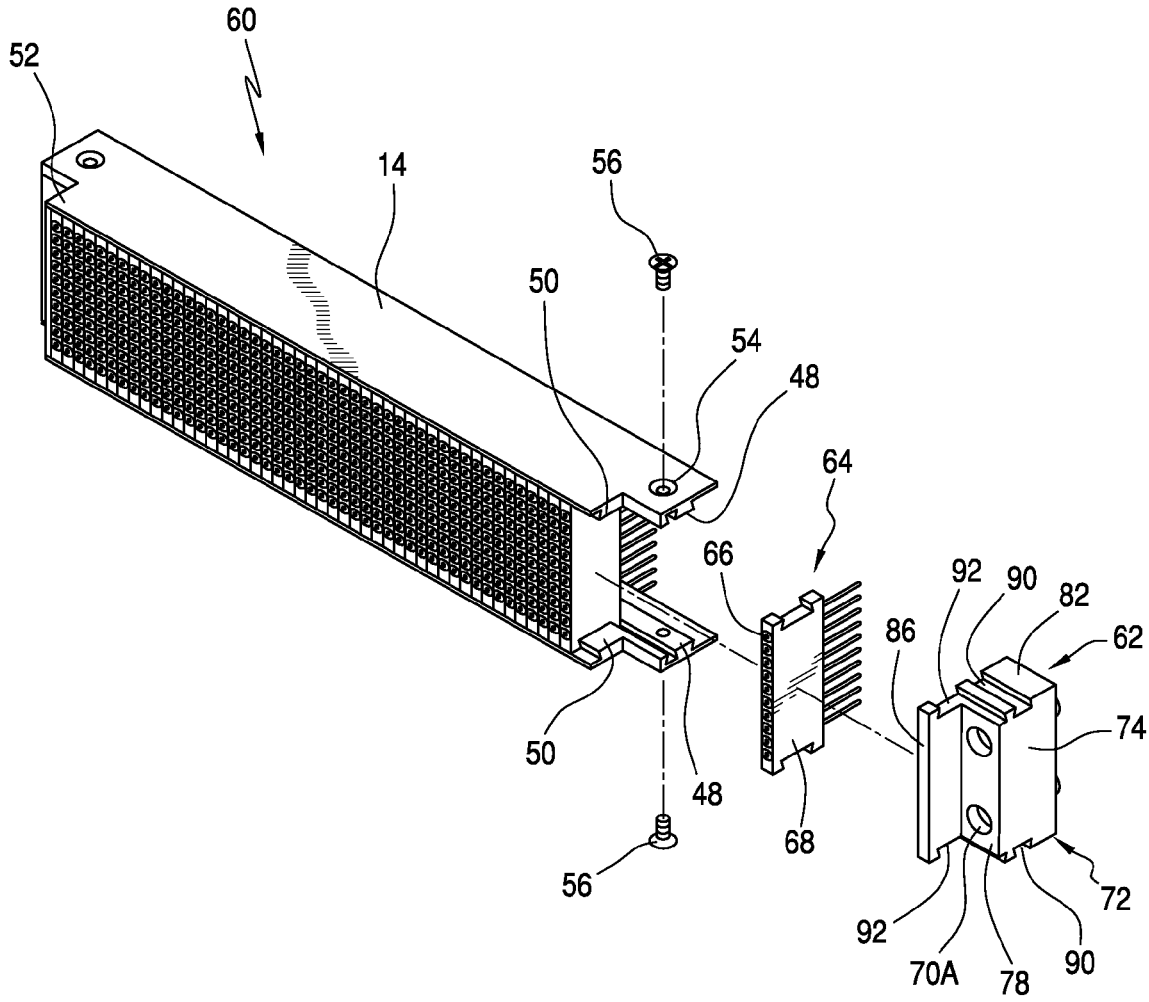
FIG. 11 is a perspective view of a second embodiment of a connector in accordance with the invention.
Figure 12:
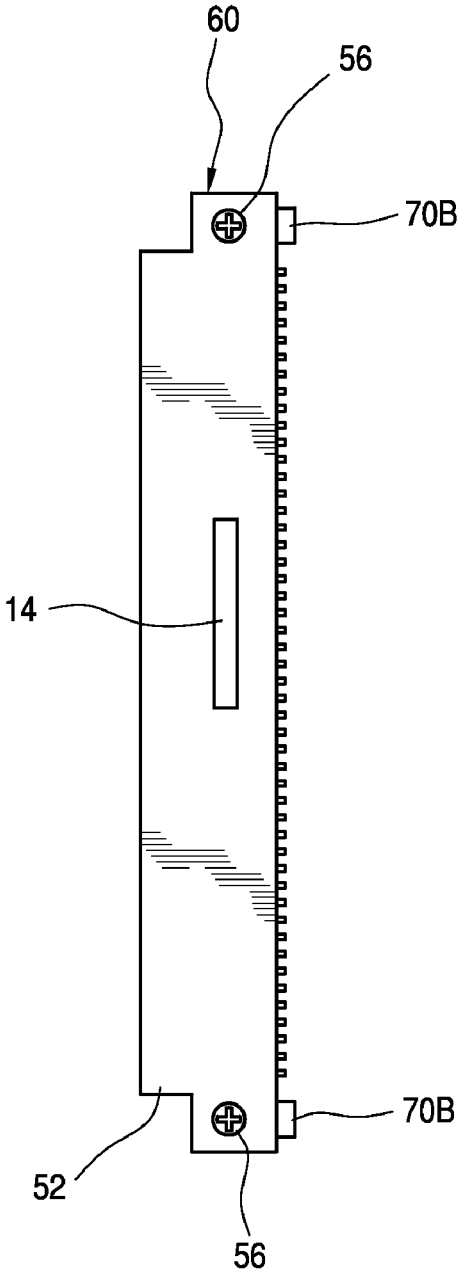
FIG. 12 is a side view of the connector shown in FIG. 11.
Figure 13:
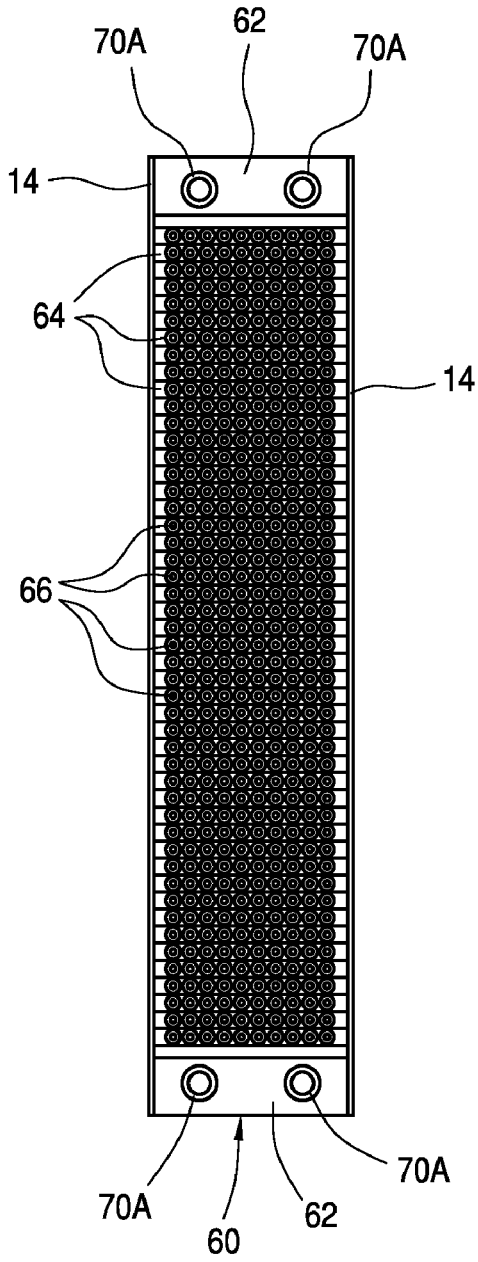
FIG. 13 is a front view of the connector shown in FIG. 11.
Figure 14:
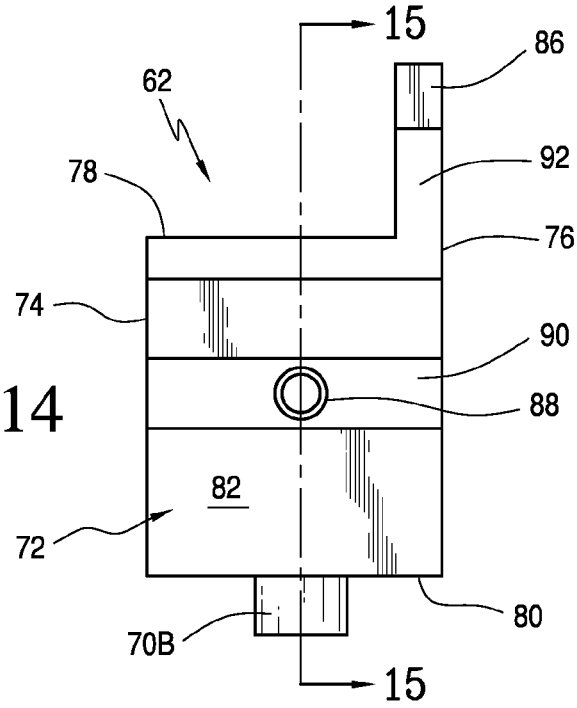
FIG. 14 is a side view of an endcap of the connector shown in FIG. 11.
Figure 15:
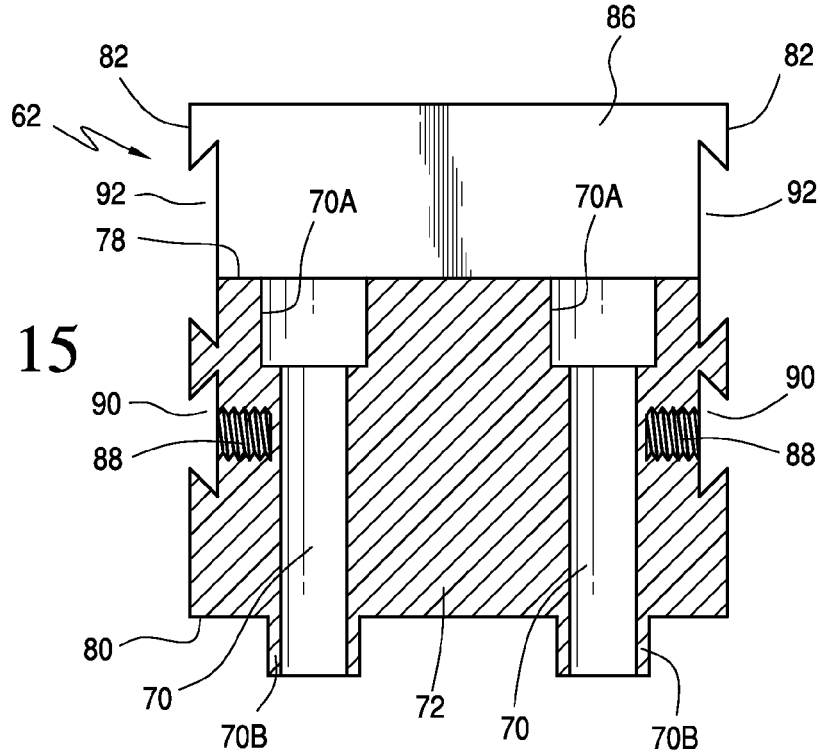
FIG. 15 is a view taken along the line 15-15 of FIG. 14.

Connector 10 is a male connector in the sense that the connector modules 16 all include only male connecting members, specifically pins 18 (see FIGS. 9 and 10). Pins can be any known type of pins used in electrical connectors but in a preferred embodiment, the pins are Hypertronics round pins designated YPN006-046H-A81, although other 0.024 round pins could be used as well. Pins 18 are held in place by a dielectric housing 20 to form each connector module 16. Thus, at least a part of each pin 18 is fixed in the dielectric housing 20 and isolated thereby from other pins 18. Each pin 18 includes connecting projections each extending from a respective side of the housing 20. Each lateral side 22 of the housing 20 includes a channel 24 in the form of a dovetail groove (see FIGS. 8 and 10).

Figure 4:
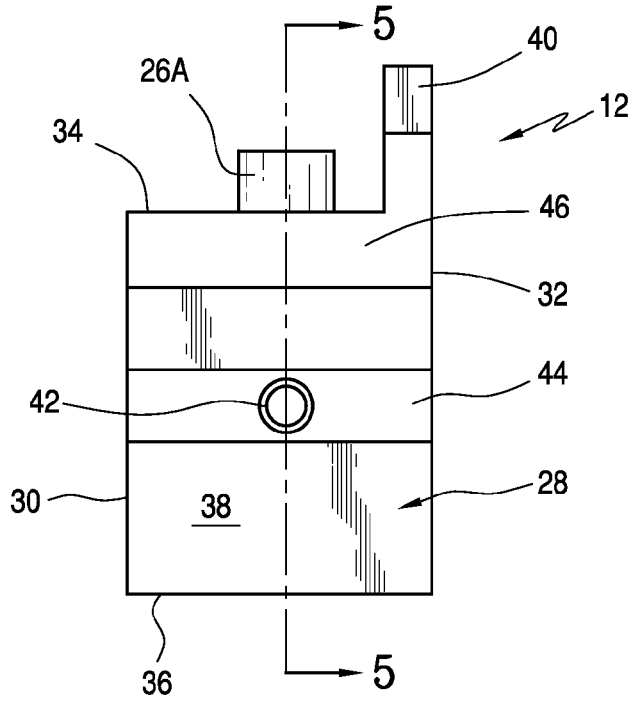
FIG. 4 is a side view of an endcap of the connector shown in FIG. 1.
Figure 5:
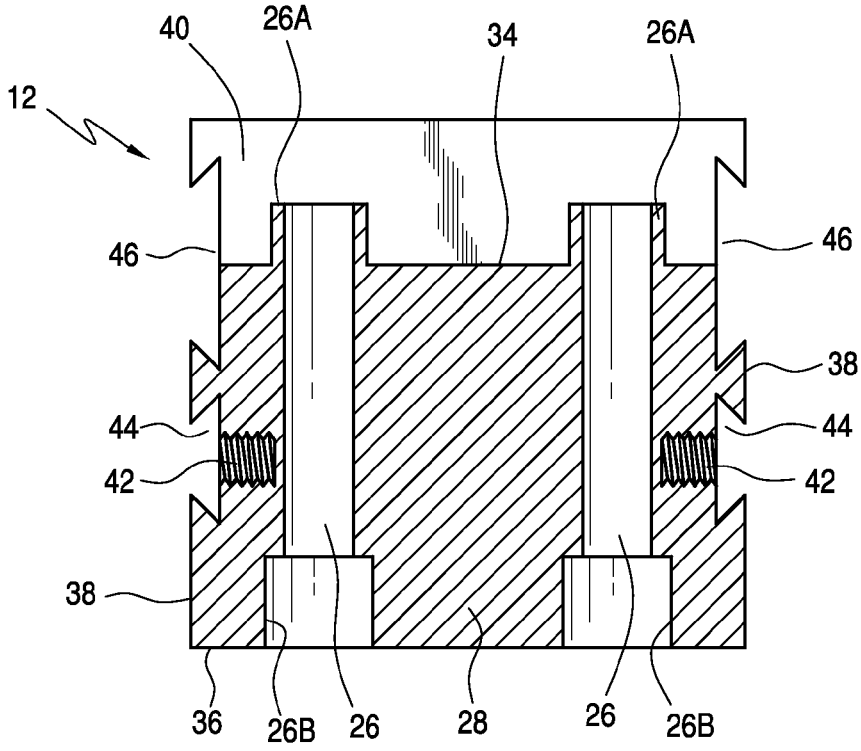
FIG. 5 is a view taken along the line 5-5 of FIG. 4.

Endcaps 12 are male endcaps in the sense that they include a pair of coupling members 26 having projections 26A oriented in the same direction as the pins 18 (i.e., in the direction of the mating surface) and recesses 26B on an opposite side (see FIGS. 1, 4 and 5). Projections 26A of the coupling members 26 are designed to mate with a complementary female coupling recess on another electrical component (discussed below).

With reference in particular to FIGS. 4 and 5, endcaps 12 each have a housing 28 having a front side 30, a rear side 32, a top 34, a bottom 36 and lateral sides 38. Projections 26A project from the top 34. A flange 40 also extends upward at a rear of the housing 28 from the top 34 and has a rear surface contiguous with the rear side 32. Screw holes 42 are formed in the lateral sides 38, the purpose of which is explained below. Lateral sides 38 each include a channel 44, and an additional, larger channel 46 is formed partially in the lateral side 38 and partially on the side of the flange 40.

Figure 6:
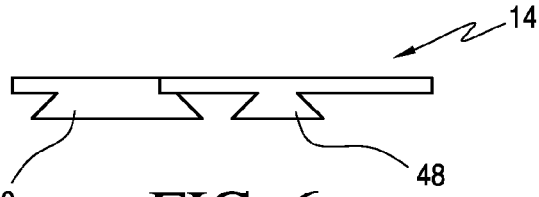
FIG. 6 is a top view of a rail of the connector shown in FIG. 1.
Figure 7:
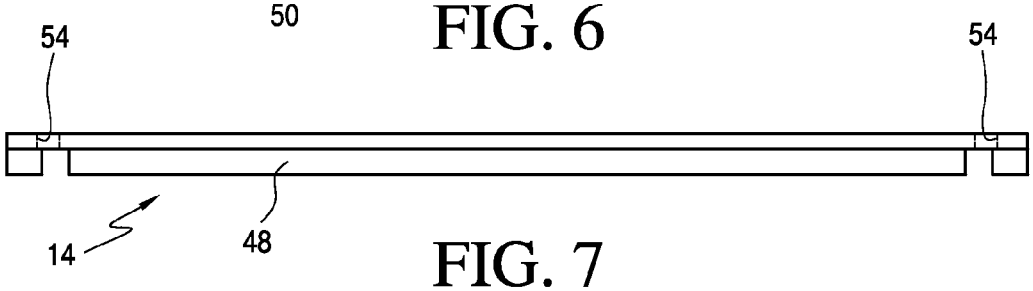
FIG. 7 is a front view of a rail of the connector shown in FIG. 1.
Figure 8:
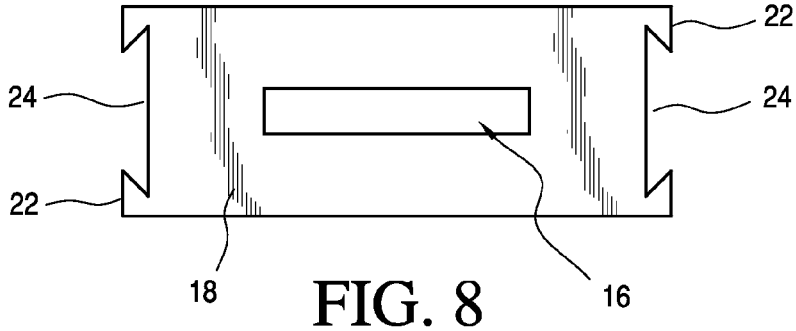
FIG. 8 is a top view of a connector module of the connector shown in FIG. 1.

Rails 14 each include a first projection 48 on an inner side extending along substantially the entire length of the rail 14 and a second projection 50 along the inner side extending along substantially the entire length of a stepped portion 52 of the rail 14 (see FIGS. 6 and 7). Projection 50 is wider than projection 48, although different relative sizes of these projections 48, 50 can be provided.

Apertures 54 are provided proximate the longitudinal ends of the rails 14 and align with the screw holes 42 in the sides 38 of the housing 28 of the endcaps 12 (see FIG. 7). Screws 56 can therefore be inserted through apertures 54 into screw holes 42 and tightened to thereby secure the rails 14 at their longitudinal ends to the endcaps 12. Instead of screws, other attachment mechanisms which enable the rails 14 to be selectively attachable to and detachable from the endcaps 12 can be provided in the invention without deviating from the scope and spirit thereof.

Projections 48, 50 have a form, i.e., size and shape, substantially complementary to the form of channels 44, 46, respectively, on the housing 28 of the endcaps 12. As such, the endcaps 12 can be engaged with the rails 14 by aligning the projections 48, 50 on the rails 14 with the channels 44, 46, respectively, on the endcaps 12 and sliding them into the respective channel 44, 46. To assemble connector 10, one end of each rail 14 is attached to one endcap 12, one rail 14 on each side of the endcap 12, by inserting the projections 48, 50 on the rail 14 into the respective channel 44, 46 on the housing 28 of the endcap 12. Screws 56 are then inserted through apertures 54 into screw holes 42 and tightened. Connector modules 16 are selected for the particular use of the connector 10, e.g., 48 of the connector modules 16 as shown, and each is slid along the rails 14 by aligning the projection 50 on the rails 14 with the channels 24 on the lateral sides 22 of the housing 20. Once the desired connector modules 16 are engaged with the rails 14 attached to one endcap 12, the other endcap 12 is engaged with the rails 14 by aligning the projections 48, 50 with the channels 44, 46 in the housing 28 of the endcap 12. Screws 56 are then inserted through apertures 54 into screw holes 42 in this second endcap 12 and tightened to thereby form connector 10.

By appropriate dimensioning of the rails 14 and selection of connector modules 16, it is possible to provide for a degree of float or play of the connector modules 16 when in the assembled connector 10. Specifically, when using connector module 10, it is useful to be able to slightly slide the connector modules 16 along the rails 14 to ensure proper positioning for mating engagement with other electrical connectors. This ability is thus provided by selection of the dimensions of the components of the connector 10.

If and when it is desired to reconfigure connector 10, the rails 14 are detached from one of the endcaps 12 by loosening the screws 56 and removing them from the screw holes 42 and apertures 54. The endcap 12 is then slid off of the rails 14 and the connector modules 16 are then also slidable off of the rails 14. The different connector modules 16 sought to be used for the re-configured connector are then placed in engagement with the rails 14 in the desired order and once all of the connector modules 16 are in place, the endcap 12 and rails 14 are re-attached to one another. When reconfiguring the connector 10, it is not required to detach both endcaps 12 from the rails 14 but rather only one of the endcaps 12 needs to be detached from the rails 14 to enable removal and replacement of the connector modules 16.

In the embodiments described above, the combination of the endcaps 12 and rails 14 defines a frame with a plurality of side members, at least one of which is separable from the remaining side members. During use of the connector 10, this separable side member (either of the endcaps 12) is fixed to the other side members (the rails 14 which in turn are fixed to the other one of the endcaps 12) but when it is desired to re-configure the connector 10, this separable side member is detached from the other side members to allow access to the interior of the frame, i.e., to allow the connector modules 16 in the interior of the frame to be removed and replaced as desired. Instead of endcaps 12 and rails 14, other constructions for defining such a frame with an accessible interior are envisioned to be within the scope and spirit of the invention. For example, the frame could be defined by only two side members, namely, a U-shaped side member and an elongate side member which closes the opening of the U-shaped member and is removably attached thereto.

Referring now to FIGS. 11-16, a second embodiment of an electrical connector in accordance with the invention is designated generally as 60 and includes a pair of endcaps 62, a pair of elongate rails 14 as described above and a plurality of connector modules 64 arranged between the endcaps 62 and in engagement with the rails 14.

Figure 16:
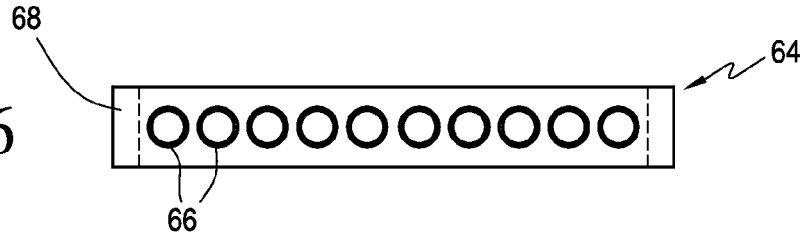
FIG. 16 is a top view of a connector module of the connector shown in FIG. 11.

Connector 60 is a female connector in the sense that the connector modules 64 all include only female connecting members, specifically sockets 66 (see FIG. 16). Sockets 66 can be any known type of sockets used in electrical connectors but in a preferred embodiment, the sockets are Hypertronics part number YSK006-031AH-A81. These sockets have a unitary construction and provide a single electrical path between a first electrical component or part thereof engaging with one end of the socket and a second electrical component or part thereof engaging with the other end of the socket. Sockets 66 are held in place by a dielectric housing 68 to form each connector module 64. Thus, at least a part of each socket 66 is fixed in the dielectric housing 68 and isolated thereby from other sockets 66. Each socket 66 includes a receptacle at one end and a connecting projection extending from the housing 68 at the other. Each lateral side of the housing 68 includes a channel in the form of a dovetail groove in a similar manner as housing 20 of connector module 16 includes a channel 24 in the form of a dovetail groove Endcaps 62 are female endcaps in the sense that they include a pair of coupling members 70 having a receptacle or recess 70A oriented inward in the same direction as the sockets 66 (i.e., in the direction of the mating surface) and a projection 70B on an opposite side (see FIGS. 14 and 15). Recesses 70A are designed to accept a screw to fasten the connector 60 to, for example, a Virginia Panel Series 90 patch panel. Projections 70B are designed to mate with a complementary female coupling (or recess) on the patch panel.

Endcaps 62 each have a housing 72 having a front side 74, a rear side 76, a top 78, a bottom 80 and lateral sides 82. A flange 86 extends upward at a rear of the housing 72 from the top 78 and has a rear surface contiguous with the rear side 76. Screw holes 88 are formed in the lateral sides 82, the purpose of which is explained below. Lateral sides 82 each include a channel 90 and an additional, larger channel 92 is formed partially in the lateral side 82 and partially on the side of the flange 86.

Channels 90, 92 have a form, i.e., size and shape, substantially complementary to the form of projections 48, 50, respectively, on the rails 14. As such, the endcaps 62 can be engaged with the rails 14 by aligning the projections 48, 50 on the rails 14 with the channels 90, 92, respectively, on the endcaps 12 and sliding them into the respective channel 90, 92.

To assemble connector 60, one end of each rail 14 is attached to one endcap 62, one rail 14 on each side of the endcap 62, by inserting the projections 48, 50 on the rail 14 into the respective channel 90, 92 on the housing 72 of the endcap 62. Screws 56 are then inserted through apertures 54 into screw holes 88 and tightened. Connector modules 64 are selected for the particular use of the connector 60, e.g., 48 of the connector modules 64 as shown, and each is slid along the rails 14 by aligning the projection 50 on the rails 14 with the channels on the lateral sides of the housing 68. Once the desired connector modules 64 are engaged with the rails 14 attached to one endcap 62, the other endcap 62 is engaged with the rails 14 by aligning the projections 48, 50 with the channels 90, 92 in the housing 72 of the endcap 62. Screws 56 are then inserted through apertures 54 into screw holes 88 in this second endcap 62 and tightened to thereby form connector 60.

If and when it is desired to reconfigure connector 60, the rails 14 are detached from one of the endcaps 62 by loosening the screws 56 and removing them from the screw holes 88 and apertures 54. The endcap 62 is then slid off of the rails 14 and the connector modules 64 are then also slidable off of the rails 14. The different connector modules 64 sought to be used for the re-configured connector are then placed in engagement with the rails 14 in the desired order and once all of the connector modules 64 are in place, the endcap 62 and rails 14 are re-attached to one another. When reconfiguring the connector 60, it is not required to detach both endcaps 62 from the rails 14 but rather only one of the endcaps 62 needs to be detached from the rails 14 to enable removal and replacement of the connector modules 64.

The illustrated connector modules 16, 64 include ten, identical pins 18 or ten, identical sockets 66. Alternative connector modules 16, 64 can be used in the invention provided each has the same general form of housing, i.e., a channel on each side which can engage with one of the projections on the rails 14. For example, possible connector modules include one which has a different number of male connecting members, one which has different male connecting members (i.e., different types of pins alongside one another), and one which could conceivably have both a male and a female connecting member. In one embodiment, different pins are used depending on the signal intended to be used, i.e., the signal being conveyed through the connector. Of course, whatever configuration is used for one connector must have a complementary configuration in an electrical component to which the connector is to be mated. Typically, the existence of electrical components with known connecting member configurations will determine the manner in which the connector modules will be assembled in a connector in accordance with the invention.

In connectors 10, 60, the coupling members 26 and 70 are shown mounted onto the endcaps 12, 62, respectively, and this is designed to ensure that the connectors 10, 60 align properly into the mating receiver or fixture. In a similar manner, the receiver and fixture also have alignment points that ensure that they mate properly.

Although the dimensions of connectors 10, 60 are variable and may be selected as needed by those skilled in the art, in one particular embodiment, the connector 10 has a width, i.e., the distance between the outer surface of one rail 14 to the outer surface of the other rail 14, of about 1.18 to about 1.20 inches, a distance between the centers of the projections 26A on each endcap 12 of about 0.6 inches and a distance between the centers of aligning projections 26A on opposing endcaps 12 of about 5.445 inches. The dimensions of the connector 60 would be similar.

Referring now to FIGS. 17-21, a third embodiment of an electrical connector in accordance with the invention is shown and is designated generally as 110. Connector 110 includes a pair of endcaps 112, a pair of elongate rails 114 attached at their ends to the endcaps 112 and a plurality of connector modules 16, as described above, arranged between the endcaps 112 and in engagement with the rails 114. Connector 110 is a male connector in the sense that the connector modules 16 all include only male connecting members, specifically pins 18 (see FIGS. 9 and 10).

Endcaps 112 are male endcaps in the sense that they include a single projecting guide pin 126 oriented in the same direction as the pins 18 (i.e., in the direction of the mating surface). Guide pins 126 are designed to mate with a complementary female coupling recess on another electrical component (discussed below).

With reference in particular to FIGS. 18 and 19, endcaps 112 each have a housing 128 having a front side 130, a rear side, a top 134, a bottom 136 and lateral sides 138. Guide pin 126 projects from the top 134. Screw holes 142 are formed in the lateral sides 138, the purpose of which is explained below. Lateral sides 138 each include a single channel 144. As shown in FIG. 19, two through apertures 140 are provided extending between the top 134 and the bottom 136.

Figure 20:
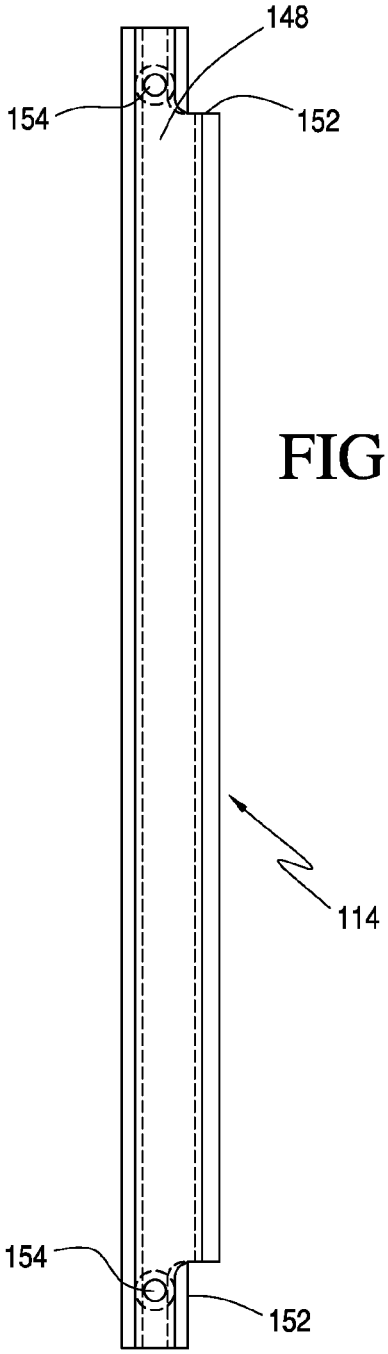
FIG. 20 is a top view of a rail of the connector shown in FIG. 17.
Figure 21:
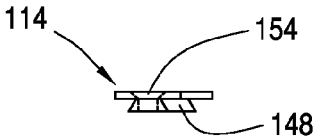
FIG. 21 is a front view of a rail of the connector shown in FIG. 17.

Rails 114 each include a single projection 148 on an inner side extending along substantially the entire length of the rail 114, and partly along a stepped portion 152 of the rail 114 (see FIGS. 20 and 21).

Apertures 154 are provided proximate the longitudinal ends of the rails 114 and align with the screw holes 142 in the sides 138 of the housing 128 of the endcaps 112. Screws 156 can therefore be inserted through apertures 154 into screw holes 142 and tightened to thereby secure the rails 114 at their longitudinal ends to the endcaps 112. Instead of screws, other attachment mechanisms which enable the rails 114 to be selectively attachable to and detachable from the endcaps 112 can be provided in the invention without deviating from the scope and spirit thereof.

Projections 148 have a form, i.e., size and shape, substantially complementary to the form of channels 144 on the housing 128 of the endcaps 112. As such, the endcaps 112 can be engaged with the rails 114 by aligning the projections 148 on the rails 114 with the channels 144 on the endcaps 112 and sliding them into the respective channel 144.

To assemble connector 110, one end of each rail 114 is attached to one endcap 112, one rail 114 on each side of the endcap 112, by inserting the projection 148 on the rail 114 into the channel 144 on the housing 128 of the endcap 112. Screws 156 are then inserted through apertures 154 into screw holes 142 and tightened. Connector modules 16 are selected for the particular use of the connector 110, e.g., 50 of the connector modules 16 as shown, and each is slid along the rails 114 by aligning the projection 148 on the rails 114 with the channels 124 on the lateral sides 122 of the housing 120. Once the desired connector modules 16 are engaged with the rails 114 attached to one endcap 112, the other endcap 112 is engaged with the rails 114 by aligning the projections 148 with the channels 144 in the housing 128 of the endcap 112. Screws 156 are then inserted through apertures 154 into screw holes 142 in this second endcap 112 and tightened to thereby form connector 110.

If and when it is desired to reconfigure connector 110, the rails 114 are detached from one of the endcaps 112 by loosening the screws 156 and removing them from the screw holes 142 and apertures 154. The endcap 112 is then slid off of the rails 114 and the connector modules 16 are then also slidable off of the rails 14. The different connector modules 16 sought to be used for the re-configured connector are then placed in engagement with the rails 114 in the desired order and once all of the connector modules 16 are in place, the endcap 112 and rails 114 are re-attached to one another. When reconfiguring the connector 110, it is not required to detach both endcaps 112 from the rails 114 but rather only one of the endcaps 112 needs to be detached from the rails 114 to enable removal and replacement of the connector modules 16.

In the embodiment described above, the combination of the endcaps 112 and rails 114 defines a frame with a plurality of side members, at least one of which is separable from the remaining side members. During use of the connector 110, this separable side member (either of the endcaps 112) is fixed to the other side members (the rails 114 which in turn are fixed to the other one of the endcaps 112) but when it is desired to re-configure the connector 110, this separable side member is detached from the other side members to allow access to the interior of the frame, i.e., to allow the connector modules 16 in the interior of the frame to be removed and replaced as desired. Instead of endcaps 112 and rails 114, other constructions for defining such a frame with an accessible interior are envisioned to be within the scope and spirit of the invention. For example, the frame could be defined by only two side members, namely, a U-shaped side member and an elongate side member which closes the opening of the U-shaped member and is removably attached thereto.

Figure 23:
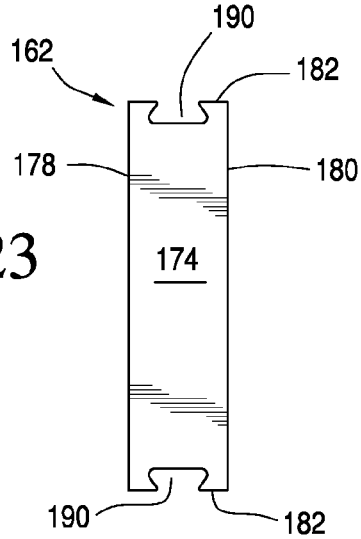
FIG. 23 is a side view of an endcap of the connector shown in FIG. 22.
Figure 24:
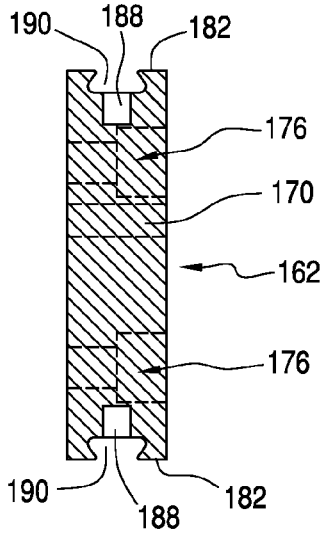
FIG. 24 is a view taken along the line 24-24 of FIG. 22.
Figures 22, 25, 27:
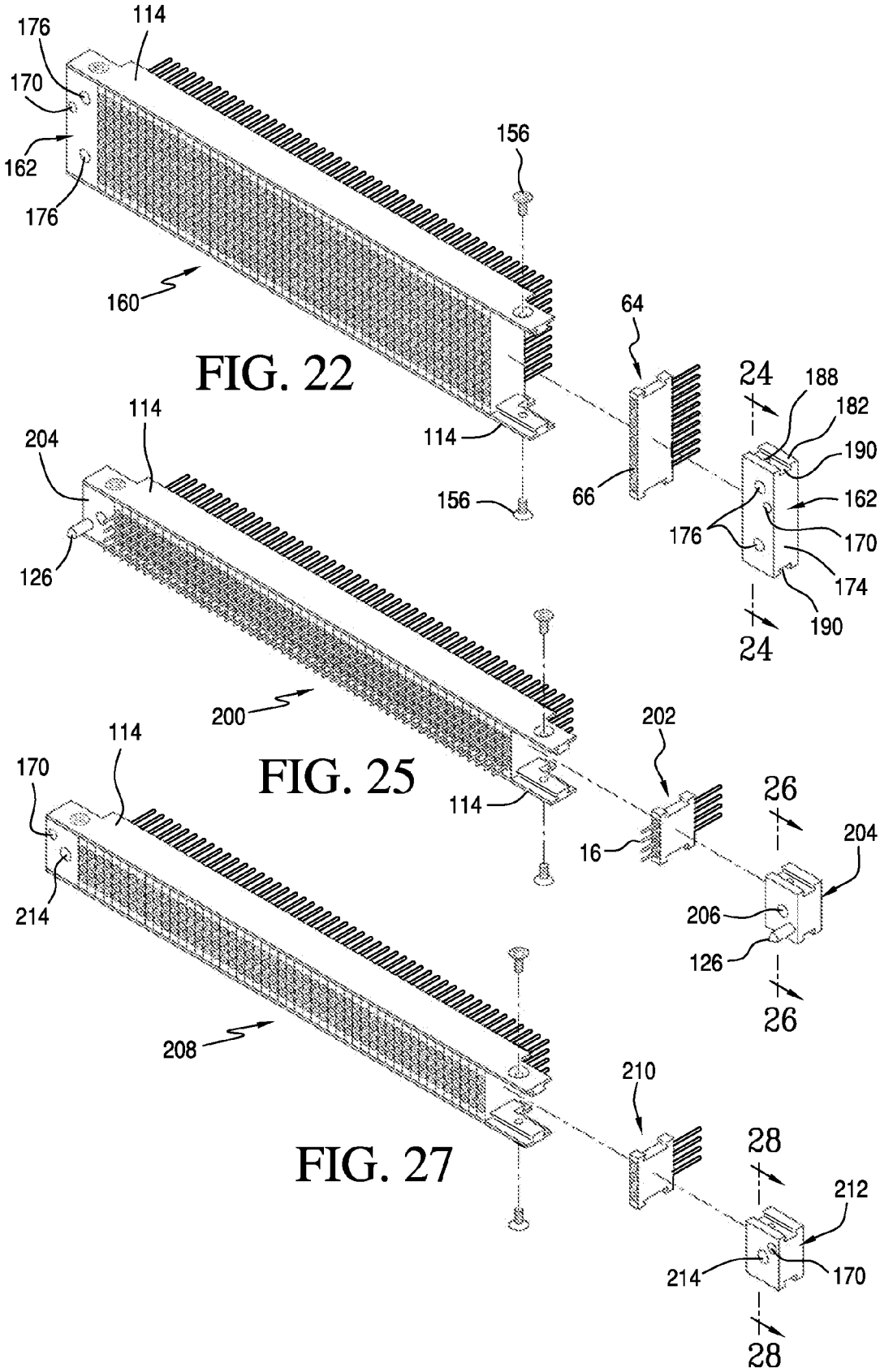
FIG. 22 is a perspective view of a fourth embodiment of a connector in accordance with the invention.
FIG. 25 is a perspective view of a fifth embodiment of a connector in accordance with the invention.
FIG. 27 is a perspective view of a sixth embodiment of a connector in accordance with the invention.

Referring now to FIGS. 22-24, a fourth embodiment of an electrical connector in accordance with the invention is designated generally as 160 and includes a pair of endcaps 162, a pair of elongate rails 114 as described above and a plurality of connector modules 64, as described above, arranged between the endcaps 162 and in engagement with the rails 114. Connector 160 is a female connector in the sense that the connector modules 64 all include only female connecting members, specifically sockets 66 (see FIG. 16).

Endcaps 162 are female endcaps in the sense that they include a single coupling member 170 defining a receptacle or recess oriented inward in the same direction as the sockets 66 (i.e., in the direction of the mating surface). The recess of coupling member 170 is designed to accept a guide pin 126 to pre-align the connector 160 to, for example, a Virginia Panel Series 90 patch panel.

Endcaps 162 each have a housing 172 having a front side 174, a rear side, a top 178, a bottom 180 and lateral sides 182. Screw holes 188 are formed in the lateral sides 182, the purpose of which is explained below. Lateral sides 182 each include a channel 190. Two through apertures 176 are provided extending between the top 134 and the bottom 136.

Channels 190 have a form, i.e., size and shape, substantially complementary to the form of projections 148 on the rails 114. As such, the endcaps 162 can be engaged with the rails 114 by aligning the projections 148 on the rails 114 with the channels 190 on the endcaps 112 and sliding them into the channel 190.

To assemble connector 160, one end of each rail 114 is attached to one endcap 162, one rail 114 on each side of the endcap 162, by inserting the projections 148 on the rail 114 into the channel 190 on the housing 172 of the endcap 162. Screws 156 are then inserted through apertures 154 into screw holes 188 and tightened. Connector modules 64 are selected for the particular use of the connector 160, e.g., 50 of the connector modules 64 as shown, and each is slid along the rails 114 by aligning the projection 150 on the rails 114 with the channels on the lateral sides of the housing 68. Once the desired connector modules 64 are engaged with the rails 114 attached to one endcap 162, the other endcap 162 is engaged with the rails 114 by aligning the projections 148 with the channels 190 in the housing 172 of the endcap 162. Screws 156 are then inserted through apertures 154 into screw holes 188 in this second endcap 162 and tightened to thereby form connector 160.

If and when it is desired to reconfigure connector 160, the rails 114 are detached from one of the endcaps 162 by loosening the screws 156 and removing them from the screw holes 188 and apertures 154. The endcap 162 is then slid off of the rails 114 and the connector modules 64 are then also slidable off of the rails 114. The different connector modules 64 sought to be used for the re-configured connector are then placed in engagement with the rails 114 in the desired order and once all of the connector modules 64 are in place, the endcap 162 and rails 114 are re-attached to one another. When reconfiguring the connector 160, it is not required to detach both endcaps 162 from the rails 114 but rather only one of the endcaps 162 needs to be detached from the rails 114 to enable removal and replacement of the connector modules 64.

In connectors 110, 160, the coupling members 126 and 170 are shown mounted onto the endcaps 112, 162, respectively, and this is designed to ensure that the connectors 110, 160 align properly into the mating receiver or fixture. In a similar manner, the receiver and fixture also have alignment points that ensure that they mate properly. Also, when connecter 110 is used in combination with connector 160, apertures 140 in end caps 112 will align with apertures 176 in endcaps 162 thereby enabling a connecting element to pass through the aligning apertures and aid in securing the connectors 110, 160 together.

Figure 26:
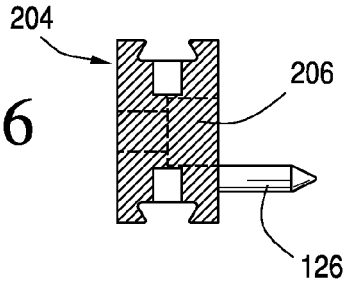
FIG. 26 is a view taken along the line 26-26 of FIG. 25.

Referring now to FIGS. 25 and 26, an embodiment of a male connector 200 is similar to connector 110 shown in FIG. 17 but connector module 202 includes four pins 16 and different endcaps 204. Endcaps 204 include only a single screw hole 206 (see FIG. 26). Otherwise, the same reference numerals designate the same elements.

Figure 28:
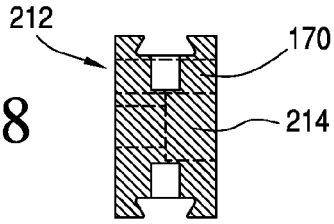
FIG. 28 is a view taken along the line 28-28 of FIG. 27.

FIG. 27 shows a mating female connector 208 for male connector 200 and is similar to connector 160 shown in FIG. 22 but connector module 210 includes four sockets 66 and different endcaps 212. Endcaps 212 include only a single screw hole 214 (see FIG. 28).

In on embodiment, connectors 200, 208 each receive 50 connector modules 202, 210, respectively, to provide each connector with 200 pin/socket connections.

In certain embodiments of the invention, different pins are used depending on the signal intended to be used, i.e., the signal being conveyed through the connector. Of course, whatever configuration is used for one connector must have a complementary configuration in an electrical component to which the connector is to be mated. Typically, the existence of electrical components with known connecting member configurations will determine the manner in which the connector modules will be assembled in a connector in accordance with the invention.

It is conceivable that in some connectors in accordance with the invention, there may be blank modules which do not contain any connecting members. Such blank modules could serve to position other connecting modules at desired locations intermediate the endcaps 12.

Regarding the material composition of connectors disclosed herein, the rails and endcaps can be made of a metal, such as aircraft-grade aluminum, which provides them with an acceptable level of rigidity for use (which level would be understood or readily determinable by those skilled in the art). The connector modules are preferably made of a material selected based on its electrical properties, such as glass-filled nylon.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. For example, although in the illustrated embodiment, the rails includes two projections and endcaps include two complementary channels, it is possible to form the rails with only one projection in which case, this projection would pass through a single channel formed in the endcap housings and also through the single channel formed in the connector module housings.

The invention claimed is:

1. An electrical connector for removable attachment to a plurality of different electrical connectors, comprising:

first and second endcaps;

first and second elongate rails, each of said first and second rails being removably attached at one end to one of said first or second endcap;

a plurality of connector modules arranged between said first and second endcaps, said connector modules being separable from one another and each including at least one male or female connecting member adapted to electrically connect at a first end to a first electrical component or part thereof and at a second, opposite end to a second electrical component or part thereof, each of said connecting members including a single projection at the first end for removably engaging with the first electrical component or part thereof and a single projection or a single receptacle at the second end for removably engaging with the second electrical component or part thereof; and positioning means for movably engaging said connector modules with said first and second rails.

2. The connector of claim 1, wherein said positioning means are arranged such that each of said connector modules is movable relative to said first and second rails when said first and second rails are detached from said first or second endcap to enable different configurations of connector modules to be positioned between said first and second endcaps and thereby provide for removable engagement with a plurality of different first electrical components and a plurality of different second electrical components.

3. The connector of claim 1, wherein said first and second endcaps each include a single channel on each side, said positioning means including a single elongate projection on each of said first and second rails each slidable into and along said channel on a respective side of said first and second endcaps, said positioning means further including a channel on each side of said connector modules, said projection on each of said first and second rails being slidable into and along said channel of said connector modules.

4. The connector of claim 1, wherein said first and second endcaps each include a single channel on each side, said positioning means including a single elongate projection on each of said first and second rails each slidable into and along said channel on a respective side of said first and second endcaps.

5. The connector of claim 1, wherein said connector modules each include a plurality of male or female connecting members and a dielectric housing, at least a part of each of said connecting members being fixed in said housing and isolated from other of said connecting members in said housing.

6. The connector of claim 1, wherein said connector is a female connector and said connector modules include only sockets which constitute said female connecting members, said sockets having the single receptacle at the second end.

7. The connector of claim 6, wherein said first and second endcaps are female endcaps each including a single coupling member having a receptacle recessed in the same direction as said receptacles at the second end of said sockets.

8. The connector of claim 1, wherein said first and second rails are removably attached at a first end to said first endcap, each of said connector modules being movable relative to said first and second rails when said first and second rails are detached from said first endcap.

9. The connector of claim 8, wherein said first and second rails are removably attached at a second end to said second endcap, each of said connector modules being movable relative to said first and second rails when said first and second rails are detached from said second endcap.

10. The connector of claim 1, wherein said connector is a male connector and said connector modules include only pins which constitute said male connecting members, said pins having the single projection at the second end.

11. The connector of claim 10, wherein said first and second endcaps are male endcaps each including a single guide pin oriented in the same direction as said projections at the first end of said pins.

12. The connector of claim 10, wherein said plurality of connector modules comprises 48 connector modules or 50 connector modules and each of said connector modules has 4 or 10 pins.

13. An electrical connector for attachment to a plurality of different electrical components, comprising:

a plurality of individual connector modules each including at least one male or female connecting member adapted to electrically connect at a first end to a first electrical component or part thereof and at a second, opposite end to a second electrical component or part thereof, each of said connecting members including only a single projection at the first end for engaging with the first electrical component or part thereof and only a single projection or only a single receptacle at the second end for engaging with the second electrical component or part thereof;

first and second elongate rails, each of said connector modules engaging at one side with said first rail and at an opposite side with said second rail;

first and second endcaps; and attachment means for removably attaching each of said first and second rails to said first or second endcap.

14. The connector of claim 13, wherein each of said connector modules is movable relative to said first and second rails when said first and second rails are detached from said first or second endcap.

15. The connector of claim 13, wherein said attachment means include a single channel on each side on each of said first and second endcaps and an elongate projection on each of said first and second rails, said projection being slidable into and along said channel on a respective side of said first and second endcaps, said connector modules each including a channel on each side, one of said projections on each of said first and second rails being slidable into and along said channel of said connector modules.

16. The connector of claim 13, wherein said connector modules each include a plurality of male or female connecting members and a dielectric housing, at least a part of each of said connecting members being fixed in said housing.

17. The connector of claim 13, wherein said first and second rails are removably attached at a first end to said first endcap, each of said connector modules being movable relative to said first and second rails when said first and second rails are detached from said first endcap.

18. The connector of claim 17, wherein said first and second rails are removably attached at a second end to said second endcap, each of said connector modules being movable relative to said first and second rails when said first and second rails are detached from said second endcap.

19. The connector of claim 13, wherein said attachment means are arranged such that when said first and second rails are detached from said first or second endcap, different configurations of connector modules are positionable between said first and second endcaps and thereby provide for removable engagement with a plurality of different first electrical components and a plurality of different second electrical components.

20. The connector of claim 19, wherein said connector is a female connector and said connector modules include only sockets which constitute said female connecting members, said sockets having the single receptacle at the second end.

21. The connector of claim 20, wherein said first and second endcaps are female endcaps each including a single coupling member having a receptacle recessed in the same direction as said receptacles at the second end of said sockets.

22. The connector of claim 13, wherein said connector is a male connector and said connector modules include only pins which constitute said male connecting members, said pins having the single projection at the second end.

23. The connector of claim 22, wherein said first and second endcaps are male endcaps each including a single guide pin oriented in the same direction as said projections at the first end of said pins.

24. The connector of claim 22, wherein said plurality of connector modules comprises 48 connector modules or 50 connector modules and each of said connector modules has 4 or 10 pins.

25. An electrical connector for removable attachment to a plurality of different electrical connectors, comprising:

a frame including a plurality of side members defining an interior space, at least a first one of said side members being detachable from any remaining side members to enable access to said interior space; and a plurality of connector modules arranged in said interior space defined by said side members, said connector modules being separated from one another and each including at least one male or female connecting member adapted to electrically connect at a first end to a first electrical component or part thereof and at a second, opposite end to a second electrical component or part thereof, each of said connecting members including a single projection at the first end for removably engaging with the first electrical component or part thereof and a single projection or a single receptacle at the second end for removably engaging with the second electrical component or part thereof, cooperating channels and projections formed in said frame and said connector modules to enable relative movement between said connector modules and said frame such that when said first side member is detached from said any remaining side members, different configurations of connector modules can be arranged in said interior space and thereby provide for removable engagement with a plurality of different first electrical components and a plurality of different second electrical components.

* * * * *